US005713232A

United States Patent [19]

Hodge

[11] Patent Number: 5,713,232

[45] Date of Patent: Feb. 3, 1998

[54] COMBINED KEY FOB AND TICKET SCRAPER

[76] Inventor: Bessie G. Hodge, 2650 Helena St., Kenner, La. 70062

[21] Appl. No.: 639,511

[22] Filed: Apr. 29, 1996

[51] Int. Cl.[6] ..... B26B 21/08

[52] U.S. Cl. ..... 70/456 R; 30/169; 15/236.01; 15/236.07; D3/210

[58] Field of Search ..... 70/456 R, 458, 70/459; 15/236.01, 236.07; 30/162, 164, 346.57; D3/210

[56] References Cited

U.S. PATENT DOCUMENTS

| | | | |
|---|---|---|---|
| D. 290,056 | 5/1987 | Hatfield | D3/210 |
| D. 293,266 | 12/1987 | Stanich | D3/210 |
| D. 311,980 | 11/1990 | Baker | D3/210 |
| 1,714,371 | 5/1929 | Jackso | 30/346.57 |
| 2,578,896 | 12/1951 | Moore | 30/162 |
| 2,754,584 | 7/1956 | Ferguson | 30/162 |
| 3,453,729 | 7/1969 | Larson | 30/162 |
| 3,855,700 | 12/1974 | Gerson et al. | 30/162 |
| 4,628,717 | 12/1986 | Blum | 70/156 R |
| 4,646,382 | 3/1987 | Smith | 15/236 R |
| 4,654,923 | 4/1987 | Faciane et al. | 15/236 R |
| 4,793,061 | 12/1988 | Rizzo, Jr. | 30/169 |
| 4,794,692 | 1/1989 | Wang | 30/162 |
| 4,881,291 | 11/1989 | Ellis | 15/236.01 |
| 4,955,138 | 9/1990 | Henke et al. | 15/236.01 |
| 5,009,009 | 4/1991 | Stinson | 15/236.01 |
| 5,497,553 | 3/1996 | Chong | 30/162 |
| 5,581,890 | 12/1996 | Schmidt | 30/162 |

FOREIGN PATENT DOCUMENTS

| | | | |
|---|---|---|---|
| 101972 | 10/1955 | France | 70/456 R |
| 1111009 | 2/1956 | France | 70/456 R |
| 0002096 | of 1891 | United Kingdom | 15/236.01 |
| 7900703 | 9/1979 | WIPO | 70/456 R |

*Primary Examiner*—Darnell M. Boucher
*Attorney, Agent, or Firm*—Joseph N. Breaux

[57] ABSTRACT

A combined key fob scraper device including a reversible scraper blade member having a first beveled scraping edge formed along a first entire width side edge thereof, a second beveled scraping edge formed along a central section of a second width side edge having a length of less than one half the width, and at least one retraction button engagement aperture formed therein; a blade member housing having a blade member receiving cavity formed therein of a size sufficient to receive therein the entire scraper blade member, a key ring receiving aperture formed through an end section thereof, and a retraction channel, having a first and second channel end, formed through an outer surface of the blade member housing and into connection with the blade member receiving cavity, having a first plurality of ratchet teeth running along a first retraction channel sidewall; and a retraction button having a ridged bottom surface adapted to engage the ratchet teeth and a blade member engagement protrusion adapted to engage the at least one retraction button engagement aperture in a manner such that movement of the retraction button causes the blade member to move.

12 Claims, 2 Drawing Sheets

COMBINED KEY FOB AND TICKET SCRAPER

TECHNICAL FIELD

The present invention relates to portable devices used to scrape films from a substrate and more particularly to a key chain fob that includes a retractable scraper member having a scraping edge adapted to scrape the protective film cover from scratch off lottery tickets and the like.

BACKGROUND ART

Many people enjoy playing the scratch off type lottery tickets. The tickets typically have game indicia such as numbers located beneath an opaque film covering. The player is required to scrape the film covering from the ticket to reveal whether the ticket is a winner or not. The film covering is designed to be tamper proof and, therefore, must be removed with a scraping tool such as the edge of a coin. Although a coin can be used, scraping with a coin is inefficient because the circular edge of the coin can only be used to scrape the film from a small area of the ticket with each scraping movement. Numerous scraping movements are required to remove sufficient film from the ticket to determine if the ticket is a winner. When only a one or two tickets are purchased at a time, a coin is an adequate scraping device. However it would be a benefit for multiple ticket purchasers to have a portable scraping device that could be used to remove the entire film covering from the ticket with only one or two scraping movements.

Although it is desirable to have a large scraping edge for use with some types of scratch off lottery tickets, other types of lottery tickets require the player to scrape only a few of a number of designated small areas when playing the game. It would be a further benefit, therefore, if the portable scraper device had at least two distinct scraping edges with one adapted for scraping only a small area of film at a time. It would also be desirable if the scraper device were easily carried in a pocket or purse and was carried for an additional reason in addition to scraping the film from lottery tickets.

GENERAL SUMMARY DISCUSSION OF INVENTION

It is thus an object of the invention to provide a combined key fob and ticket scraper that has a scraping edge adapted to scrape the entire film area from a scratch off type lottery ticket with one or two scraping movements.

It is a further object of the invention to provide a combined key fob and ticket scraper that has a scraper member that has at least two distinct scraping edges with one adapted for scraping only a small area of film at a time.

It is a still further object of the invention to provide a combined key fob and ticket scraper that has a retractable scraper member.

Accordingly, a combined key fob and scraper device is provided. Combined key fob scraper device includes a scraper blade member having a scraper width, a scraper length, a first beveled scraping edge formed along a first entire width side edge thereof, a second beveled scraping edge formed along a central section of a second width side edge having a length of less than one half the first width, and at least one retraction button engagement aperture formed therein; a blade member housing having a blade member receiving cavity formed therein of a size sufficient to receive therein the entire scraper blade member and that is accessible through a blade member positioning port that sized to allow the scraper blade member to pass width wise therethrough, a key ring receiving aperture formed through an end section thereof, and a retraction channel, having a first and second channel end, formed through an outer surface of the blade member housing and into connection with the blade member receiving cavity, having a first plurality of ratchet teeth running along a first retraction channel sidewall; and a retraction button having a ridged bottom surface adapted to engage the ratchet teeth and a blade member engagement protrusion adapted to engage the at least one retraction button engagement aperture in a manner such that when a first button end is in contact with the first channel end the blade member is extended to a farthest point and when a second button end is in contact with the second channel end the blade member is retracted entirely into the blade member receiving cavity.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
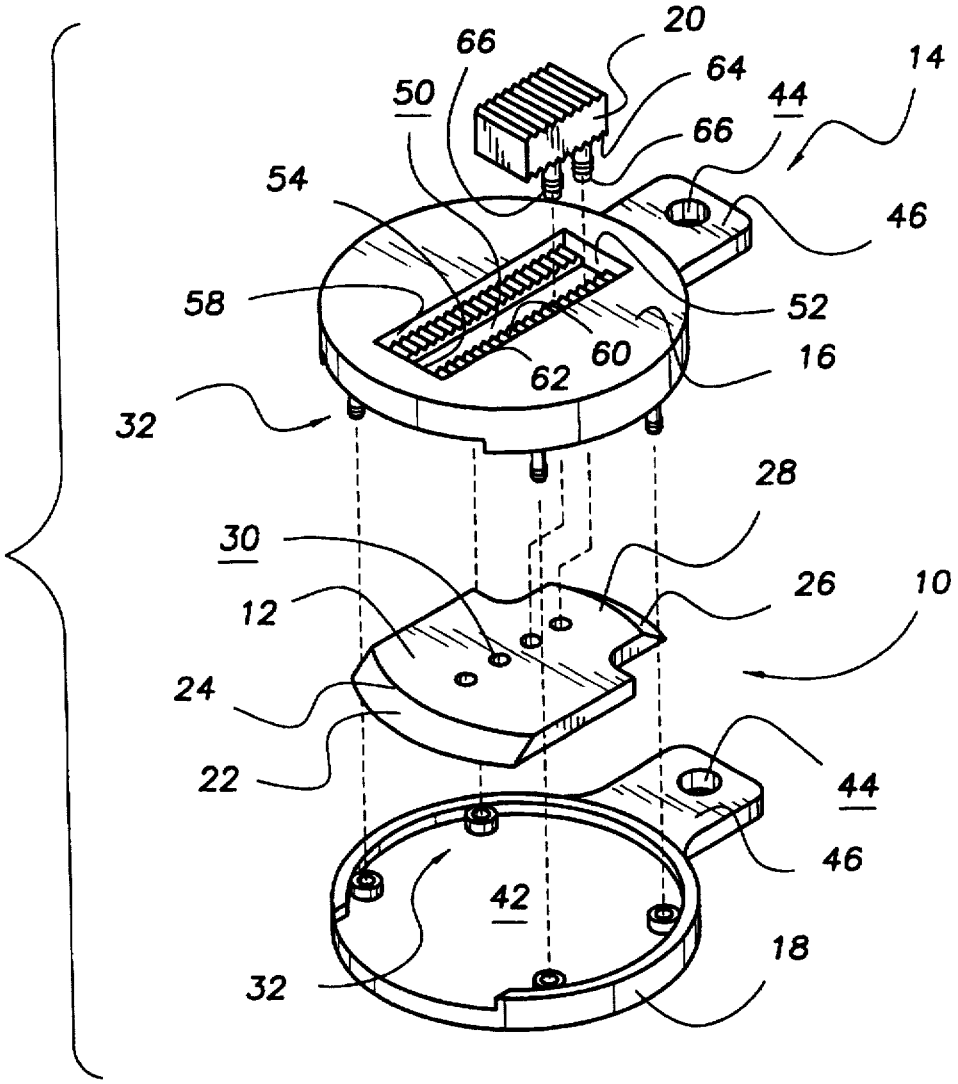
FIG. 1 is an exploded perspective view of an exemplary embodiment of the combined key fob scraper device of the present invention showing the scraper blade member, a snap-apart blade member housing having first and second snap connectable housing members; and a retraction button having two blade member engagement protrusions adapted to engage two of the four retraction button engagement apertures of the blade member at a time.

FIG. 1 is an exploded perspective view showing an exemplary embodiment of the combined key fob scraper device of the present invention generally designated by the numeral 10. Key fob scraper device 10 includes a scraper blade member 12; a snap-apart blade member housing, generally designated by the numeral 14, having first and second snap connectable housing members 16,18; and a retraction button 20.

Scraper blade member 12 is molded from high impact styrene plastic and is about one (1") inch wide, about one and three quarter (1¾") inches long, and has substantially planer upper and lower surfaces. A first one inch long beveled scraping edge 22 is formed along a first side edge 24. A second beveled scraping edge 26 having a length of about one third (⅓") inch is centrally located on a second side edge 28. Four centrally positioned retraction button engagement apertures 30 are formed along a line bisecting scraper blade member 12 along its width.

Figure 1A:
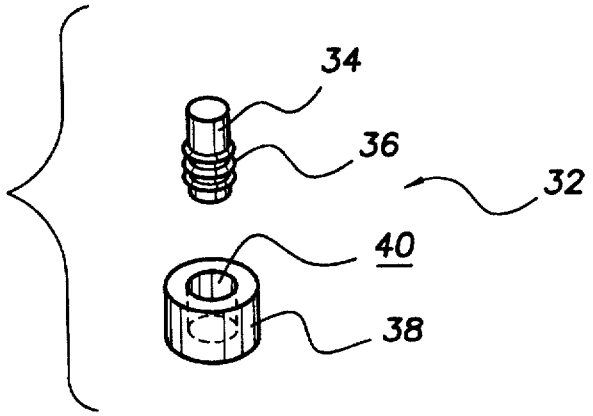
FIG. 1A is a detail side view of a snap connector showing an insertion snap portion having three circumferential ridges and a receiving snap portion having a receiving compartment sized to frictionally receive and engage a snap portion.

Snap-apart blade member housing 14 is formed from first and second snap connectable housing members 16,18. First and second snap connectable housing members 16,18 are constructed from high impact styrene plastic and are secured together with four snap connectors 32. With reference to FIG. 1A, each snap connector 32 includes an insertion snap portion 34, having three circumferential ridges 36, and a receiving snap portion 38 having a receiving compartment 40 sized to frictionally receive and engage a snap portion 34.

With reference once again to FIG. 1, first and second snap connectable housing members 16,18 are snapped together by aligning the four snap connectors 32 and pressing together. First and second snap connectable housing members 16,18 are disconnected by pulling apart. When snapped together, first and second snap connectable housing members 16,18 form a blade member receiving cavity 42 (also shown in FIG. 4). A key ring receiving aperture 44 is formed through an extended end 46 of each of the first and second snap connectable housing members 16,18. Key receiving aperture 44 is sized to receive a conventional key ring therethrough in a manner to allow combined key fob scraper device 10 to be used as a key fob if desired.

First snap connectable housing member 16 has a substantially rectangular retraction channel 50 formed therethrough. Retraction channel 50 has a first channel end 52 and a second channel end 54. A first plurality of ratchet teeth 56 run along a first retraction channel sidewall 58 and a second plurality of ratchet teeth 60 run along an opposite retraction channel sidewall 62.

Retraction button 20 is a substantially rectangular block of plastic having a ridged bottom surface 64 that is adapted to engage the first and second pluralities of ratchet teeth 56,60. A pair of blade member engagement protrusions 66 extend from ridged bottom surface 64 that are adapted to engage two of the four retraction button engagement apertures 30 at a time.

Key fob scraper device 10 can be assembled with blade member engagement protrusions 66 installed within the two retraction button engagement apertures 30 located adjacent second beveled scraping edge 26 when it is desired to utilize first beveled scraping edge 22 as the scraping element and installed within the two retraction button engagement apertures 30 located adjacent first beveled scraping edge 22 when it is desired to utilize second beveled scraping edge 26 as the scraping element. Scraper blade member 12 can thus be reversed to position the desired scraping edge 22,24 toward the working end of combined key fob scraper device 10.

Figure 2:
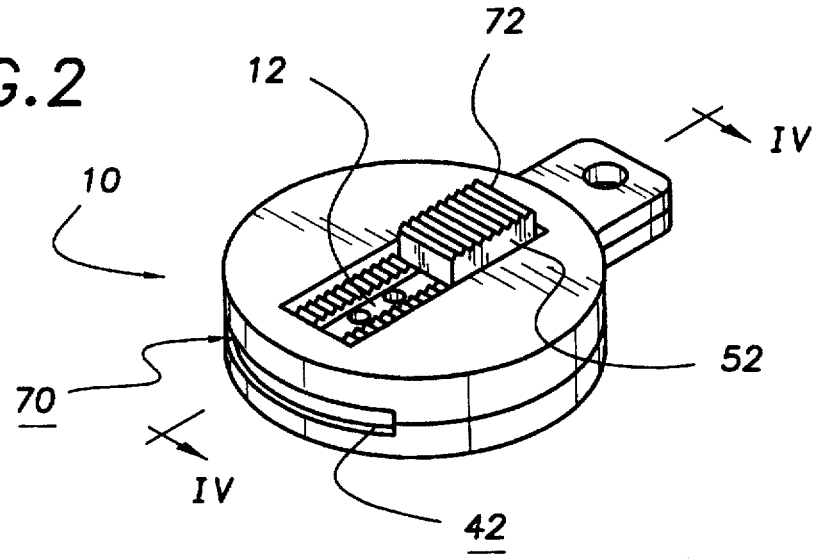
FIG. 2 is a perspective view of the combined key fob scraper device of FIG. 1 showing the scraper blade member completely retracted within blade member housing and the first and second snap connectable housing members snapped together.
Figure 3:
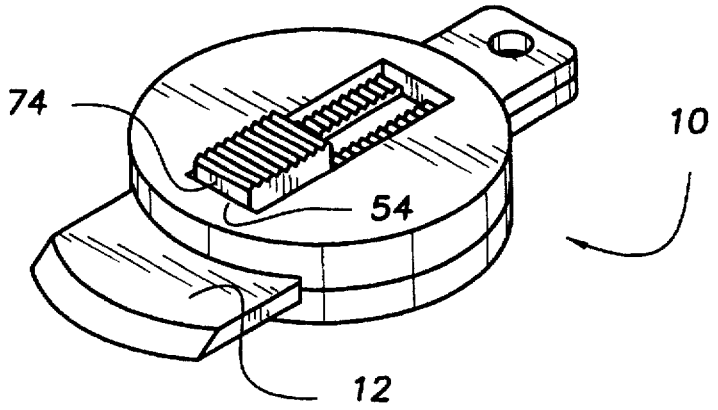
FIG. 3 is a perspective view of the combined key fob scraper device of FIG. 1 showing the scraper blade member at the farthest extension point from the blade member housing and the first and second snap connectable housing members snapped together to form the blade member housing.

With reference to FIG. 2, when key fob scraper device 10 is assembled, blade member 12 is fully retracted within blade member receiving cavity 42 through a blade member positioning port 70 by positioning a first button end 72 in contact with first channel end 54 (also shown in FIG. 1). With reference to FIG. 3, blade member 12 is extended to a farthest point from key fob scraper device 10 by positioning a second button 74 end in contact with the second channel end 54 (also shown in FIG. 1). When blade member 12 is fully extended the exposed scraping edge 22,26 can be used to remove the film covering from a scratch off ticket.

Figure 4:
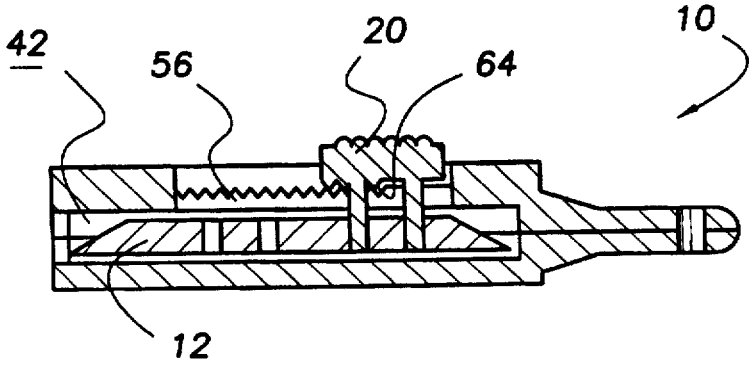
FIG. 4 is a cross-sectional view of the combined key fob scraper device along the line IV—IV of FIG. 2 along showing the second button end of the retraction button in contact with the second channel end, the blade member is retracted entirely into the blade member receiving cavity, and the two blade member engagement protrusions engaged with two of the four retraction button engagement apertures of the blade member.

FIG. 4 is a cross sectional view of key fob scraper device 10 along the line IV—IV of FIG. 2 showing blade member 12 positioned within blade member receiving cavity 42. Ridged bottom surface 64 of retraction button 20 is shown in engagement with the first plurality of ratchet teeth 56.

It can be seen from the preceding description that a combined key fob and ticket scraper that has been provided that has a scraping edge adapted to scrape the entire film area from a scratch off type lottery ticket with one or two scraping movements; that has a retractable scraper member; and that has at least two distinct scraping edges with one adapted for scraping only a small area of film at a time.

It is noted that the embodiment of the combined key fob and ticket scraper described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combined key fob and ticket scraper comprising:

a scraper blade member having a scraper width, a scraper length, a first beveled scraping edge formed along an entire first width side edge thereof, a second beveled scraping edge formed along a central section of a second width side edge having a length of less than one half said first width, and at least one retraction button engagement aperture formed therein;

a blade member housing having a blade member receiving cavity formed therein of a size sufficient to receive therein said scraper blade member and that is accessible through a blade member positioning port that sized to allow said scraper blade member to pass width wise therethrough, a key ring receiving aperture formed through an end section thereof, and a retraction channel, having a first and second channel end, formed through an outer surface of said blade member housing and into connection with said blade member receiving cavity, having a first plurality of ratchet teeth running along a first retraction channel sidewall; and a retraction button having a ridged bottom surface adapted to engage said ratchet teeth and a blade member engagement protrusion adapted to engage said at least one retraction button engagement aperture in a manner such that when a first button end is in contact with said first channel end said blade member is extended to a farthest point and when a second button end is in contact with said second channel end said blade member is retracted entirely into said blade member receiving cavity.

2. The combined key fob and ticket scraper of claim 1, wherein:

said blade member housing is constructed from first and second snap connectable housing members.

3. The combined key fob and ticket scraper of claim 2, wherein:

said first and second snap connectable housing members are secured together with four snap connectors, each snap connector including an insertion snap portion and a receiving snap portion, said receiving snap portion having a receiving compartment sized to frictionally receive and engage said snap portion.

4. The combined key fob and ticket scraper of claim 1 wherein:

said blade member includes four centrally positioned retraction button engagement apertures formed along a line bisecting scraper blade member along a width thereof.

5. The combined key fob and ticket scraper of claim 1 wherein:

said retraction channel is substantially rectangular in shape and has first plurality of ratchet teeth located along a first retraction channel sidewall and a second plurality of ratchet teeth located along an opposite retraction channel sidewall.

6. The combined key fob and ticket scraper of claim 2 wherein:

said blade member includes four centrally positioned retraction button engagement apertures formed along a line bisecting scraper blade member along a width thereof.

7. The combined key fob and ticket scraper of claim 2 wherein:

said retraction channel is substantially rectangular in shape and has first plurality of ratchet teeth located along a first retraction channel sidewall and a second plurality of ratchet teeth located along an opposite retraction channel sidewall.

8. The combined key fob and ticket scraper of claim 3 wherein:

said blade member includes four centrally positioned retraction button engagement apertures formed along a line bisecting scraper blade member along a width thereof.

9. The combined key fob and ticket scraper of claim 3 wherein:

said retraction channel is substantially rectangular in shape and has first plurality of ratchet teeth located along a first retraction channel sidewall and a second plurality of ratchet teeth located along an opposite retraction channel sidewall.

10. The combined key fob and ticket scraper of claim 8 wherein:

said retraction channel is substantially rectangular in shape and has first plurality of ratchet teeth located along a first retraction channel sidewall and a second plurality of ratchet teeth located along an opposite retraction channel sidewall.

11. The combined key fob and ticket scraper of claim 6 wherein:

said retraction channel is substantially rectangular in shape and has first plurality of ratchet teeth located along a first retraction channel sidewall and a second plurality of ratchet teeth located along an opposite retraction channel sidewall.

12. The combined key fob and ticket scraper of claim 4 wherein:

said retraction channel is substantially rectangular in shape and has first plurality of ratchet teeth located along a first retraction channel sidewall and a second plurality of ratchet teeth located along an opposite retraction channel sidewall.

* * * * *